US008564212B2

(12) United States Patent
Hsieh et al.

(10) Patent No.: US 8,564,212 B2
(45) Date of Patent: Oct. 22, 2013

(54) APPROPRIATE LED ARRANGEMENT AND POWER NEED IN LARGE-SCALE LED DISPLAY AND LIGHTING APPARATUS AND METHOD THEREOF

(75) Inventors: Guan-Chyun Hsieh, Chung Li (TW); Cheng-Chih Chu, Chung Li (TW)

(73) Assignee: Chung Yuan Christian University, Chung Li (TW)

( * ) Notice: Subject to any disclaimer, the term of this patent is extended or adjusted under 35 U.S.C. 154(b) by 69 days.

(21) Appl. No.: 13/180,431

(22) Filed: Jul. 11, 2011

(65) Prior Publication Data

US 2013/0016496 A1 Jan. 17, 2013

(51) Int. Cl.
*H05B 37/02* (2006.01)

(52) U.S. Cl.
USPC ..... 315/192; 315/185 S; 315/185 R; 315/291; 345/102

(58) Field of Classification Search
USPC ..... 315/185 S, 185 R, 192, 291; 345/102
See application file for complete search history.

(56) References Cited

U.S. PATENT DOCUMENTS

| | | | | |
|---|---|---|---|---|
| 5,489,742 | A * | 2/1996 | Hammer et al. | 800/9 |
| 7,852,009 | B2 * | 12/2010 | Coleman et al. | 315/185 S |
| 2008/0316164 | A1 * | 12/2008 | Tan | 345/102 |
| 2011/0163682 | A1 * | 7/2011 | Jungwirth | 315/192 |

OTHER PUBLICATIONS

Hsieh et al: "An Appropriate Arrangement of Multiple LEDs for Optimal Power Need", 12th Int'l Symp. Science and Technology of Light Sources and 3rd Int'l Conf. White LED and Solid State Lighting, pp. 221-222, Netherlands, Jul. 11-16, 2010.

* cited by examiner

*Primary Examiner* — Douglas W Owens
*Assistant Examiner* — Thai Pham

(57) ABSTRACT

Method for managing power of a display and apparatus thereof are provided. The proposed method includes the following steps: calculating a most appropriating voltage value and a most appropriating current value form a plurality of LEDs; and obtaining a first optimal working point according to the most appropriating voltage value and the most appropriating current value, wherein the first optimal working point is used for arranging the plurality of LEDs.

4 Claims, 5 Drawing Sheets where $I_{max,k}=q_k I_D$ $V_{max,k}=p_k V_D$ $I_{min,k}=I_k V_{max,k}=V_D$

APPROPRIATE LED ARRANGEMENT AND POWER NEED IN LARGE-SCALE LED DISPLAY AND LIGHTING APPARATUS AND METHOD THEREOF

CROSS-REFERENCES TO RELATED APPLICATIONS

This application claims the benefit of the conference paper entitled "AN APPROPRIATE ARRANGEMENT OF MULTIPLE LEDS FOR OPTIMAL POWER NEED" in 12th Int'l Symp. Science and Technology of Light Sources and 3rd Int'l Conf. White LED and Solid State Lighting, pp. 221-222, Netherlands, Jul. 11-16, 2010, which is incorporated by reference as if fully set forth herein.

FIELD OF THE INVENTION

The present invention relates to a method of managing power of a plurality of light emitting diodes (LEDs), in particular to the method of arranging the ways of connecting LEDs in parallel and in serial in displays.

BACKGROUND OF THE INVENTION

Aiming at energy-saving and mercury-free environmental requirements, LED technologies have become the most important lighting source applied in large-scale LCD panels or lighting apparatuses. Based on thermal consideration, the LED rated power below 1 Watt even lower than 0.1 Watt has been the major cell device applied in nowadays displays or lighting apparatuses. A large amount, hundreds even thousands, of LEDs are necessary to be arranged in an apparatus and their connections are mostly in serial and/or in parallel forms. However, the combination form and the power demand for LEDs are very closely related to each other in design consideration. Therefore, the power demand for operating LEDs is highly related to the arrangement of LEDs.

A very high voltage is required if a large amount of LEDs are merely serially connected in one string, where a much larger current is required if the LEDs are only connected in parallel strings. As a result, it is necessary for a power supply to be configured with very high (low) output voltage and with very low (high) current source if all LEDs are connected only in serial or in parallel.

In other words, improper combination may raise the difficulty of the power design for driving multiple LEDs (multi-LEDs). Moreover, a large amount of LEDs connected only in either serial or parallel form may increase the probability of failure when operating LED devices and raise the difficulty for designing power supplies, and causing thermal issues as well. In fact, the above-mentioned issues are difficult to be solved by simply biasing the multi-LEDs in a stable operation region. A preferred biasing strategy for such as transistor, diode, and even power LEDs, is to place the operating point around the intermediate portion of the power dissipation (PD) curve to gain excellent performance. However, most literatures focus only on the promotion of LED drive configurations and are lack of investigation on the mentioned issues, even the estimation of power need is also scarce and scattered.

Therefore, an advanced method for solving the above-mentioned issues is highly needed.

SUMMARY OF THE INVENTION

The present application utilizes a widely used mean-value approach, which is much closer to the practical problems, to find a proper bias operating point of the multi-LEDs, and then to determine an appropriate combination and power need for determining the LED arrangement and power supply design, respectively.

Besides, the present application also explores a simple LED layout strategy to prevent from possible electromagnetic interference and overloading in voltage. Finally, a design example implementing a LED backlighting display for a 20 inches TV verifies the feasibility of the proposed method.

According to the first aspect of the present invention, a method for managing a power source of a display, comprising a plurality of light emitting diodes (LEDs) having a voltage value and a current value, comprises steps of: calculating an optimized voltage value and an optimized current value for the display; and obtaining a first optimal working point for the display according to the optimized voltage value and the optimized current value.

According to the second aspect of the present invention, a backlight device having a plurality of LEDs comprising a plurality of parallel connected LED cascades having N LEDs, wherein N is a positive integer, and a total number of the plurality of parallel connected LED cascades being one of a floor value and a ceiling value of a square root of N, and a total number of serially connected LEDs in each of the plurality of parallel connected LED cascades equals to a positive integer being one of a floor value and a ceiling value of the square root of N.

According to the third aspect of the present invention, a backlight device having a plurality of LEDs comprises a plurality of parallel connected LED cascades having N LEDs, wherein N is a positive integer, and a total number of the plurality of parallel connected LED cascades equals to a positive integer being one of a floor value and a ceiling value of a square root of N.

According to the fourth aspect of the present invention, a lighting apparatus having a plurality of LEDs comprises a plurality of parallel connected LED cascades having N LEDs, wherein N is a positive integer, and a total number of serially connected LEDs in each of the plurality of parallel connected LED cascades equals to a positive integer being one of a floor value and a ceiling value of a square root of N.

Other objects, advantages and efficacy of the present invention will be described in detail below taken from the preferred embodiments with reference to the accompanying drawings, in which:

Figure 1:
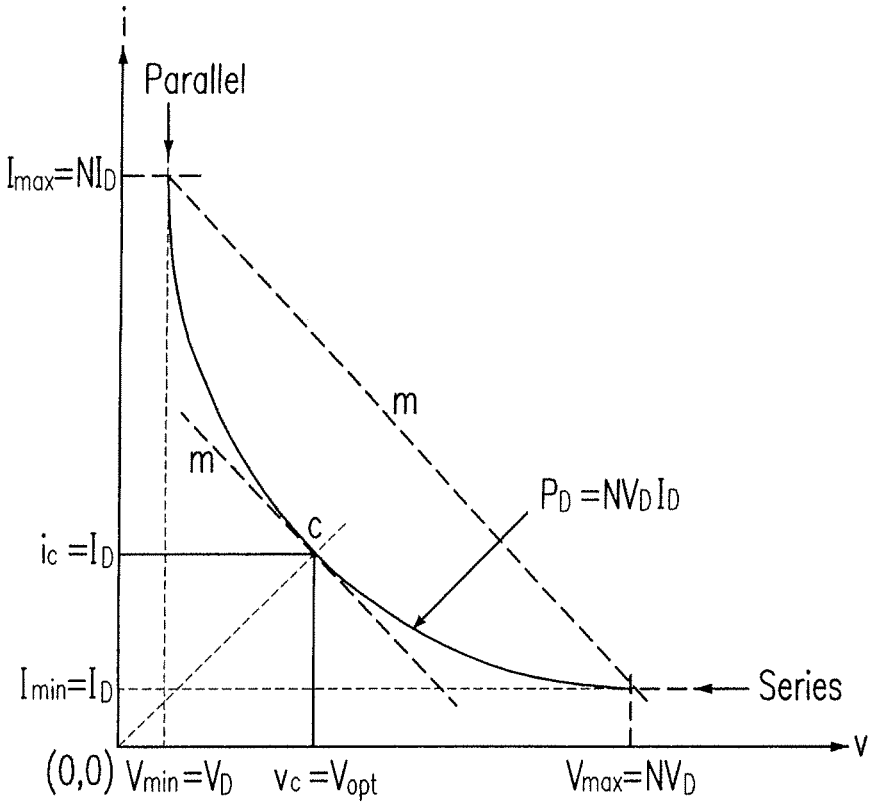
FIG. 1 is a diagram illustrating the proposed PD curve of the LEDs and the first deduction of finding their appropriate operating point for the estimation of combination and power need according to the present invention.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF THE PREFERRED EMBODIMENT

The present invention will now be described more specifically with reference to the following embodiments. It is to be noted that the following descriptions of preferred embodiments of this invention are presented herein for purposes of illustration and description only; it is not intended to be exhaustive or to be limited to the precise disclosed form.

First of all, we establish a PD curve of multi-LEDs on i-v plane to describe their power behavior. An average conductance g, of multi-LEDs derived between the two rated end points of the PD curve is then moved in a direction that translates the PD curve to a tangent point, where the appropriate operation point of the multi-LEDs is located. In addition, a general deduction process to further find an appropriate LED arrangement as well as the power need is also presented. An estimation of finding an appropriate combination for large amount of the LEDs can then be easily acquired by simply taking multiple square roots of the number of LEDs after multiple deductions. The necessary times for deduction depend on whether the estimated LED arrangement is suitable for power supply design.

In general, the consideration for well biasing an individual LED is to place the operating point around the middle portion of the maximum power dissipation (PD) curve and not over the safe-operating area (SOA). However, the bias idea of multi-LEDs is basically the same as that of individual LED. We first define multi-LEDs as N LEDs, where N is an integer. Based on the device characteristic, we can easily describe the PD curve of the N LEDs on i-v axis as shown in FIG. 1. Interestingly, all LEDs connected in series and those connected in parallel can be easily found at the two rated ends of the proposed PD curve in FIG. 1. Accordingly, the power dissipation $P_D$ of N LEDs on i-v plane can then be described by $$P_D = NV_D \cdot I_D \equiv V_{max} I_{min} \tag{1}$$

for all connected in series, or $$P_D = NI_D \cdot V_D \equiv I_{max} V_{min} \tag{2}$$

for all connected in parallel. Where $V_D$ and $I_D$ are respectively the forward voltage and current of an individual LED, and we define $V_{max}=NV_D$, $V_{min}=V_D$, $I_{max}=NI_D$, and $I_{min}=I_D$.

Figure 2A:
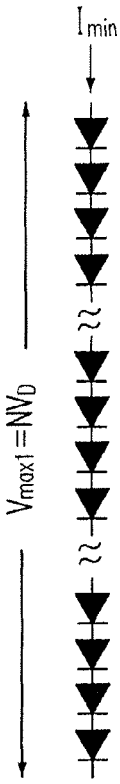
FIG. 2A is a diagram illustrating that the LEDs are connected in one series according to the present invention.
Figure 2B:
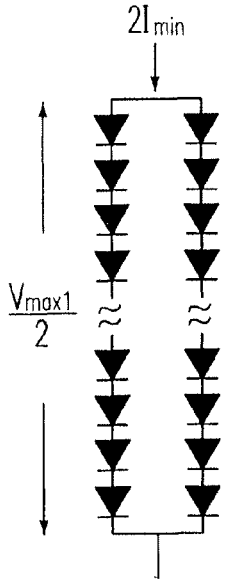
FIG. 2B is a diagram illustrating that the LEDs are parallel connected in two series according to the present invention.
Figure 2C:
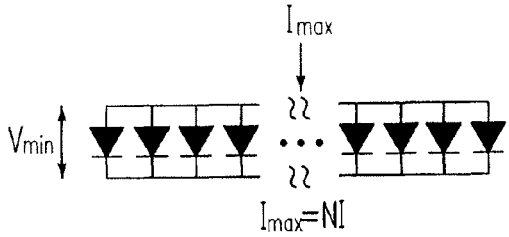
FIG. 2C is a diagram illustrating that the LEDs are parallel connected in N series according to the present invention.

Both Eq. Eqs. (1) and (2) are equivalent to each other in this case. The proposed PD curve of multi-LEDs depicted in FIG. 1 is basically valid under the rated power of SOA. The case on PD curve of maximum rated current at $I_{max}=NI_D$ with minimum parallel string voltage $V_{min}=V_D$ is exactly the situation of all LEDs connected in parallel. On the other hand, that of the maximum rated voltage $V_{max}=NV_D$ with minimum string is exactly for all LEDs connected in series. Accordingly, the possible combination in series and/or in parallel can be easily acquired along the PD curve by changing the integer N. If an intuitive bisection method conducts, the combination in series and/or in parallel can be easily established as shown in FIG. 2A-2C, which is usual cases of guessing design strategy.

In fact, the LED arrangement and power need are tightly related each other, which significantly concerns the power supply design and the operation situation of multi-LEDs for uniformly producing luminous output as expected. Therefore, how to estimate appropriate combination of multi-LEDs for arrangement as well as to match the power need for power supply design is quite an important issue in a large-scale LED display.

Modeling by mean-value approach Basically, the PD curve of N LEDs as proposed in FIG. 1 can be easily achieved by referring to the rated power from manufacture. The current i of the N LEDs in terms of voltage v along the PD curve on i-v plane can be obtained by $$i = f(v) = \frac{P_D}{v} \tag{3}$$

If f(v) in FIG. 1 is continuous in $[V_{min}, V_{max}]$ and differentiable in $(V_{min}, V_{max})$, there exists some point $v_c \in (V_{min}, V_{max})$ such that $$f(V_{max})-f(V_{min})=f'(v_c)(V_{max}-V_{min}) \tag{4}$$

From Eq. (3), yield $$f'(v_c) = -\frac{P_D}{v_c^2} \tag{5}$$

and $$v_c^2 = P_D \frac{V_{max} - V_{min}}{I_{max} - I_{min}} = V_{max} V_{min} \tag{6}$$

It is obtained that $$v_c \equiv V_{opt} = \sqrt{V_{max} V_{min}} \tag{7}$$

where $v_c=V_{opt}$ is the optimal voltage. The optimal current $I_{opt}$ can then be given, from Eqs. (1) and (7), by $$i_c \equiv I_{opt} = \sqrt{I_{max} I_{min}} \tag{8}$$

The average conductance $g_{av}$ of multi-LEDs can be easily given by plotting a line between the two rated ends of the PD curve under SOA, that is $$g_{av} = m \equiv -\frac{I_{max} - I_{min}}{V_{max} - V_{min}} \tag{9}$$

where $g_{av}$ defined is equivalent to a slope m.

In Eq. (9), the minus sign means the conductance descends along the PD curve when the operating current decreases and voltage increases, and vice versa, which basically should comply with $P_D=NV_DI_D$. If we try to move the average conductance line $g_{av}$ in a direction that parallels the tangent line of the PD curve at a point c with slope m as the green line in FIG. 1, the appropriate operation point of N LEDs given by $(i_c, v_c)=(V_{opt}, I_{opt})$ is then obtained from Eqs. (7) and (8). Accordingly, this operation point c contributes the appropriate estimation in combination and power need for the multi-LEDs to be arranged. We define the arrangement of LEDs after estimation consists of q parallel strings and each string has p LEDs in series connection. From Eqs. (7) and (8), we then have the required power need from the estimated operation point given by $$V_{opt}=\sqrt{V_{\max}V_{\min}}=pV_D \tag{10}$$

and $$I_{opt}=\sqrt{I_{\max}I_{\min}}=qI_D \tag{11}$$

Interestingly, from Eqs. (1), (2), (10) and (11), we then have a simple and compact expression for the estimated combination of multi-LEDs, that is, $$p=q=\sqrt{N} \tag{12}$$

Eq. (12) intuitively shows the easy estimation by simply taking the square root of the total number of N LEDs to be arranged. Especially, the number of parallel strings is certainly the same as those of series strings, which indeed simplifies the design idea developed in this brief.

Generalized Approach to Optimal Arrangement If much larger amount of LEDs is to be arranged in a display panel, the estimation from Eqs. (10) and (11) for such point c in FIG. 1 may not fully satisfy the design consideration due to probable difficulty in power design after the first derivation. This situation may occur due to the estimated serial string voltage of LEDs is still so high. Therefore, a further estimation for continuously finding another combination suitable for power design is necessary. The continuous estimation process can be seen in FIG. 3, in which only two deduction processes are explored for instance. The second deduction for finding the second operating point $(V_{opt2}, I_{opt2})$ on i-v coordinate is easily conducted by only considering the first estimated optimal point $(V_{opt1}, I_{opt1})$. That is, the first derived string voltage and parallel current, and the point $(V_{max1}, I_{min1})$. In other words, only points between $c_1$ and a on the PD curve are considered as the design references during the second deduction. It should be noted that the operating point a at $(V_{max1}, I_{min1})=(NV_D, I_D)$ in FIG. 3 is exactly the point $(V_{max}, I_{min})=(NV_D, I_D)$ in FIG. 1.

Figure 3:
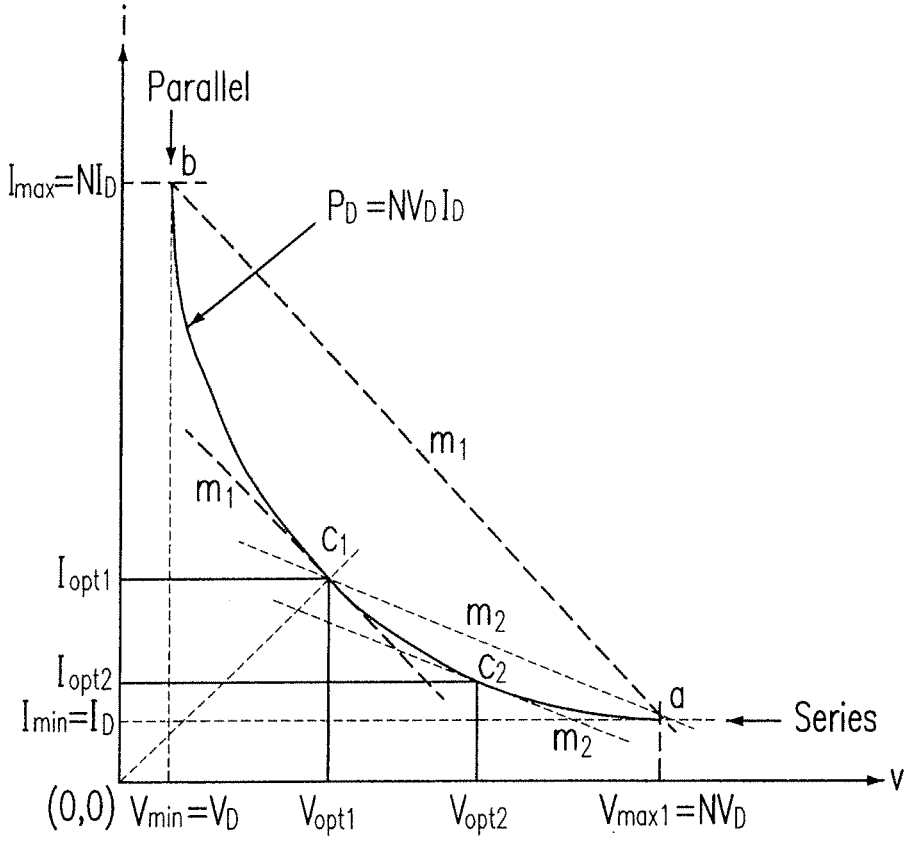
FIG. 3 is a diagram illustrating the process to find the appropriate operating point of multi-LEDs for estimating the combination and the power need, including the first and second deductions.

Additionally, the point a on PD curve in FIG. 3 always remains unchanged regardless of multiple deduction processes. In FIG. 3, the second deduction process for fording the second average conductance $g_{av2}$ and the slope $m_2$ is the same as that in the first deduction. By utilizing the mean-value approach with trigonometric translational method, the $g_{av2}$ line tangential to point $c_2$ of the PD curve gives the second optimal point at $(V_{opt2}, I_{opt2})$ on i-v plane. The generalizing derivation for kth deduction referred to FIG. 3 can be described as follows.

$$V_{max,k}=p_kV_D \tag{13}$$

$$V_{min,k}=V_D \tag{14}$$

$$I_{max,k}=q_kI_D \tag{15}$$

and $$I_{min,k}=I_D \tag{16}$$

where k□1. With reference to Eqs. (10)-(12), we can find the k-th optimum point for voltage and current.

$$V_{opt,k}=\sqrt{V_{\max,k}V_{\min,k}}=p_kV_D \tag{17}$$

and $$I_{opt,k}=\sqrt{I_{\max,k}I_{\min,k}}=q_kI_D=p_kI_D \tag{18}$$

where $p_k=q_k$ is the same as the Eq. (12) of the first derivation. From Eqs. (12), (17) and (18), we have $$p_k = N^{\frac{1}{2k}} \tag{19}$$

for k□1.

Eq. 19 gives the k-th combination for arranging $N=(p_k)^{2k}$ LEDs. In other words, there have $\sqrt{N}$ parallel strings and each series string has $\sqrt{N}$ LEDs in the first deduction. Entering the second deduction, each of parallel strings is further partitioned into {fourth root}$\sqrt{N}$ sub-parallel strings and each sub-series string has {fourth root}$\sqrt{N}$ LEDs. In other words, we then have total of {fourth root}$\sqrt{N}\cdot\sqrt{N}$ sub-parallel strings and each sub-series string has {fourth root}$\sqrt{N}$ LEDs after the second deduction. Possibly going on the subsequent deduction process depends on whether the estimated sub-string voltage reaches the proper power need for power design. Thus, the total number of the parallel strings $Q_k$ after the kth deduction will be $$\begin{aligned} Q_k &= N^{\frac{1}{2}}\cdot N^{\frac{1}{4}}\cdot N^{\frac{1}{6}}\ \ldots\ N^{\frac{1}{2k}} \\ &= N^{\sum_{k=1}^{\infty}\frac{1}{2k}} \end{aligned} \tag{20}$$

and the kth series string always has the number of LEDs the same as the Eq. (19).

Figure 4A:
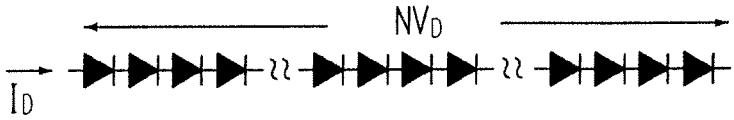
FIG. 4A is a diagram illustrating that N LEDs are originally connected in one series.
Figure 4B:
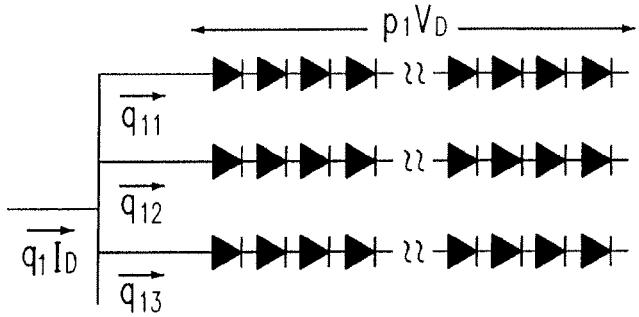
FIG. 4B is a diagram illustrating the estimated combinations of N LEDs for arrangement after the first deduction.

FIG. 4A shows that N LEDs are originally connected in one series. The estimated combination of N LEDs after the first deduction is shown in FIG. 4B, and the estimated combination of N LEDs after two deductions for example is realized in FIG. 4C, in which the estimated parallel strings are $q_{11}+q_{12}+q_{13}+\ldots$ for the first deduction, and then $q_{11}$ will partition into $q_{211}+q_{212}+q_{213}+\ldots$, and $q_{12}$ into $q_{221}+q_{222}+q_{223}+\ldots, \ldots$ and so on after the second deduction. Finally, the total 2nd-estimated parallel strings in this example will be $N^{3/4}$ from Eq. (20) and each $2^{nd}$-estimated series string has LEDs of $N^{1/4}$ from Eq. (19), where N is the number of LEDs to be arranged.

If much more quantity of sub-parallel strings estimated is required after multiple deductions, increasing power modules in parallel to share the large current request is feasible in design consideration. In practice, the required deduction would be no more than two to four times since the estimation is simply counted by taking square root of the number of LEDs.

Eq. 19 gives a general estimation to determine the number of LEDs in the kth-estimated series string by simply taking k square roots through the kth deduction, in which the total number of the parallel strings is given in Eq. 20. The appropriate power need can be easily estimated for power design according to the kth operating point of the multi-LEDs given from Eqs. 17 and 18. In practice, we first check whether the estimated string voltage is suitable for power design after the first deduction. If not, a further deduction should continuously conduct until the power need reaches the proper power design reference. If the estimated string voltage is still so high then further deduction is necessary until reaching a suitable requirement for design.

Figure 4C:
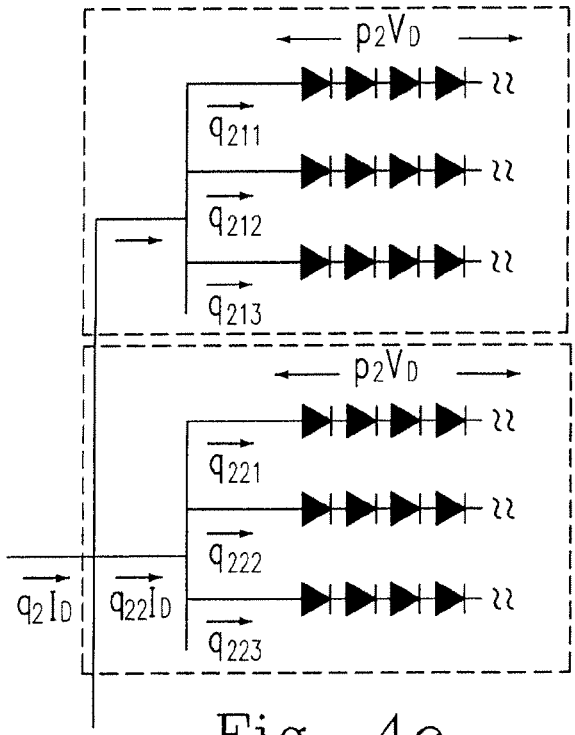
FIG. 4C is a diagram illustrating the estimated combinations of N LEDs for arrangement after the second deduction.

However, if many parallel strings are required after multiple deductions, such as shown in FIG. 4C for example, much large current request in power design may be necessary. In this situation, increasing multiple power modules in parallel for current sharing are the way in design consideration. Moreover, it is quite important for LED layout to avoid LED fault and prevent interference between series and parallel strings during arrangement. Additionally, an interlacing arrangement in layout is suggested to reduce the electromagnetic interference and possible LED fault between the neighboring strings.

Figure 5:
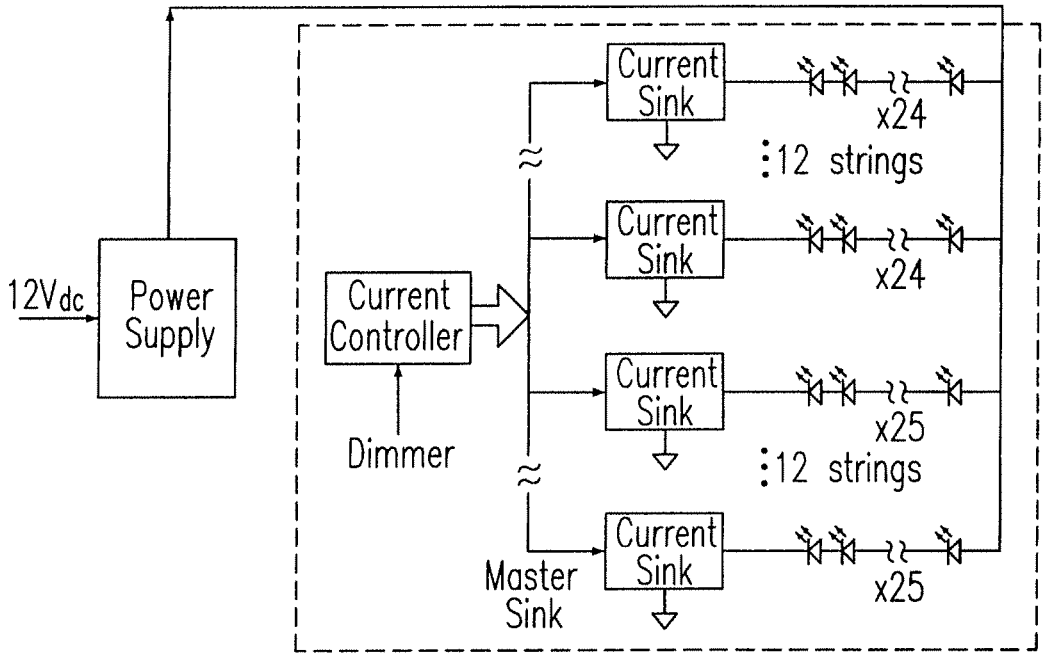
FIG. 5 is a diagram illustrating an exemplary circuit scheme for driving multi-LEDs in a 20' LED TV panel.

An exemplary design of the present invention is shown in FIG. 5. A LED display for a 20 inch LCD TV with area of 41 cm×31 cm=1271 $cm^2$ is designed to be fulfilled about 600 LEDs, in which each white LEDs has rated current 25 mA and rated power $P_D$=110 mW. After calculation in real area of the display, the possible quantity of LEDs to be used is 588. The white LED in normal condition has forward voltage $V_D$=3.5V and current $I_D$=20 mA. The relative parameters for the 588 LEDs in this design are respectively estimated as follows: From Eq. (1), the maximum power dissipation is given by:

$$P_D=3.5V\times0.02A\times588=41.16W \tag{21}$$

For all LEDs connected in series, we have $$V_{max}=3.5V\times588=2058V \tag{22}$$

and $$I_{min}=20\text{ mA} \tag{23}$$

For all LEDs connected in parallel, we have $$V_{min}=3.5V \tag{24}$$

and $$I_{max}=20\text{ mA}\times588=11.76A \tag{25}$$

The PD curve of the 588 LEDs can then be easily plotted with reference to FIG. 1 according to Eqs. (21)-(25). From Eqs. (7) and (8), after the first deduction, we can easily find the optimal operating point for the total 588 LEDs, i.e., $$\begin{aligned} V_{opt} &= \sqrt{V_{min}\times V_{max}} \\ &= \sqrt{3.5\times588\times3.5} \\ &= 84.87V \end{aligned} \tag{26}$$

and $$\begin{aligned} I_{opt} &= \sqrt{I_{min}\times I_{max}} \\ &= \sqrt{20\times588\times20} \\ &= 484.97\text{ mA} \end{aligned} \tag{27}$$

From Eq. (9), we have the average conductance $g_{av}$=5.63 mS at ($V_{opt}$, $I_{opt}$) on the PD curve of i-v plane. The number of parallel strings q and p LEDs in each series string can then be respectively estimated by, from Eqs. (10) and (11), $$p=84.87V\div3.5V\approx24.25 \tag{28}$$

and $$q=484.97\text{ mA}\div20\text{ mA}\approx24.25 \tag{29}$$

Both p and q are equivalent to meet Eq. (12). Since the estimated power need in Eqs. (26) and (27) are suitable for power design, no further deduction is required in this design. In realization, if we employ 24 parallel strings and each string has 24 LEDs in series, there will be lack of 12 LEDs for arrangement.

However, a minor modification conducts in this design using 24 LEDs in series for twelve series strings and 25 LEDs in series for another twelve strings, in which total parallel strings are still kept as 24. Thus in all, we have 24×12+25×12=588 LEDs completely meeting the specification. This approach will make the string voltage difference within 3.5V between all 24 strings of LEDs, which can be compensated in power supply design. From Eqs. (26) and (27), a 48 W boost converter with $V_i$=12$V_{dc}$, $V_{out}$=96$V_{dc}$, $I_o$=0.5 A, and switching frequency $f_s$=50 kHz is designed and implemented. In order to ensure the capacity of the power supply afford to meet the estimated string voltage of 88$V_{dc}$, the output voltage up to 96$V_{dc}$ and output power of 48 W with 10% of tolerant capacity is considered. Moreover, the suggested implementation as shown in FIG. 6 outlines in parallel with 24 current sink circuits supplied by a constant voltage source estimated as 96$V_{dc}$. The above illustrated experiment shows excellent performance for the multi-LEDs biasing with the estimated power supply to produce almost uniform luminous output in the display during a wide-range dimming process, and a linear current regulator is employed as current sink circuit for current balance among all strings.

Since the output voltage of the designed power supply has 10% of tolerant capacity, the current sink circuit can then regulate itself against the voltage variation of the string LEDs, the currents in 24 strings are almost close to each other. All LEDs in the display panel can produce almost equal luminous output during a wide-range dimming from dark to 550 cd/$m^2$ measured at 50 cm. The experimental setup for realizing the proposed strategy and evidencing its feasibility is shown in FIG. 7.

To sum up, in the present invention, an appropriate combination and power need for large amount of LEDs arranged in a display is estimated by simply taking the square root of the number of LEDs. Moreover, a general estimation for much large amount of LEDs is also achieved by simply taking multiple square roots of the number of LEDs. Implementing consideration for harmonizing the estimated parameters, such as the LED arrangement, power design, and current balance, are clearly explored in the practical example. A design example for a typical 20' LED TV display with 588 LEDs is examined for verifying the feasibility of the proposed strategy. Experimental result evidences the proposed strategy enables the large amount of LEDs biased at a well operating state and almost producing equally luminous output in the display from dark to 550 cd/$m^2$ measured at 50 cm during a wide-range dimmer control.

Embodiments

1. A method for managing a power source of a display, comprising a plurality of light emitting diodes (LEDs) having a voltage value and a current value, the method comprising steps of:

calculating an optimized voltage value and an optimized current value for the display; and obtaining a first optimal working point for the display according to the optimized voltage value and the optimized current value.

2. The method as claimed in Embodiment 1, further comprising steps of:

using a square root of a total number of the plurality of LEDs to determine a first reference value being one of a floor value and a ceiling value of the square root; and arranging the plurality of LEDs as a first plurality of parallel connected LED cascades according to the first optimal working point, and a total number of the first plurality of parallel connected LED cascades of the plurality of LEDs equals to the first reference value, wherein a total number of serially connected LEDs in each of the first plurality of parallel connected LED cascades equals to the first reference value.

3. The method as claimed in Embodiment 1 or 2, further comprising steps of:

using a square root of the first reference value to determine a second reference value being one of a floor value and a ceiling value of the square root thereof;

obtaining a second optimal working point according to the optimized voltage value and the optimized current value;

arranging a second plurality of parallel connected LED cascades according to the second optimal working point; and connecting the first plurality of LED cascades to the second plurality of parallel connected LED cascades, wherein a total number of serially connected LEDs in each of the second plurality of parallel connected LED cascades equals to the second reference value.

4. The method as claimed in anyone of the above-mentioned Embodiments, further comprising a step of obtaining a k-th optimal working point, wherein k is a positive integer.

5. The method as claimed in anyone of the above-mentioned Embodiments, further comprising steps of:

using a power of $$\frac{1}{2k}$$

of the total number of me plurality of LEDs (N), to determine a k-th reference value being one of a floor value and a ceiling value of the power of $$\frac{1}{2k}$$

of N;

arranging a k-th plurality of parallel connected LED cascades according to the k-th optimal working point; and connecting a (k−1)th plurality of LED cascades to the k-th plurality of parallel connected LED cascades, wherein a total number of parallel connected k-th LED cascades equals to a positive integer being one of a floor value and a ceiling value of a power of $$\sum_{m=1}^{k} \frac{1}{2m}$$

of N, and a total number of serially connected LEDs in each of the k-th plurality of LED cascades equals to the k-th reference value.

6. The method as claimed in anyone of the above-mentioned Embodiments, wherein the required voltage for operating each of the plurality of LEDs is essentially 3.5 volts.

7. The method as claimed in anyone of the above-mentioned Embodiments, wherein the method is implemented by one being selected from a group consisting of a notebook, a mobile device and a lighting device.

8. A backlight device having a plurality of LEDs, comprising:

a plurality of parallel connected LED cascades having N LEDs, wherein N is a positive integer, and a total number of the plurality of parallel connected LED cascades being one of a floor value and a ceiling value of a square root of N; and a total number of serially connected LEDs in each of the plurality of parallel connected LED cascades equals to a positive integer being one of a floor value and a ceiling value of the square root of N.

9. A backlight device having a plurality of LEDs, comprising:

a plurality of parallel connected LED cascades having N LEDs, wherein N is a positive integer, and a total number of the plurality of parallel connected LED cascades equals to a positive integer being one of a floor value and a ceiling value of a square root of N.

10. A lighting apparatus having a plurality of LEDs, comprising:

a plurality of parallel connected LED cascades having N LEDs, wherein N is a positive integer, and a total number of serially connected LEDs in each of the plurality of parallel connected LED cascades equals to a positive integer being one of a floor value and a ceiling value of a square root of N.

While the invention has been described in terms of what is presently considered to be the most practical and preferred embodiments, it is to be understood that the invention needs not be limited to the disclosed embodiments. Therefore, it is intended to cover various modifications and similar configuration included within the spirit and scope of the appended claims, which are to be accorded with the broadest interpretation so as to encompass all such modifications and similar structures.

What is claimed is:

1. A method for managing a power source of a display, comprising a plurality of light emitting diodes (LEDs) having a voltage value and a current value, the method comprising steps of:

calculating an optimized voltage value and an optimized current value for the display;

obtaining a first optimal working point for the display according to the optimized voltage value and the optimized current value;

using a square root of a total number of the plurality of LEDs to determine a first reference value being one of a floor value and a ceiling value of the square root;

arranging the plurality of LEDs as a first plurality of parallel connected LED cascades according to the first optimal working point, and a total number of the first plurality of parallel connected LED cascades of the plurality of LEDs equaling the first reference value, wherein a total number of serially connected LEDs in each of the first plurality of parallel connected LED cascades equals the first reference value;

using a square root of the first reference value to determine a second reference value being one of a floor value and a ceiling value of the square root thereof;

obtaining a second optimal working point according to the optimized voltage value and the optimized current value;

arranging a second plurality of parallel connected LED cascades according to the second optimal working point; and connecting the first plurality of LED cascades to the second plurality of parallel connected LED cascades, wherein a total number of serially connected LEDs in each of the second plurality of parallel connected LED cascades equals the second reference value.

2. The method as claimed in claim 1, wherein the required voltage for operating each of the plurality of LEDs is essentially 3.5 volts.

3. The method as claimed in in claim 1, wherein the method is implemented by one being selected from a group consisting of a notebook, a mobile device and a lighting device.

4. A method for managing a power source of a display, comprising a plurality of light emitting diodes (LEDs) having a voltage value and a current value, the method comprising steps of:

calculating an optimized voltage value and an optimized current value for the display;

obtaining a first optimal working point for the display according to the optimized voltage value and the optimized current value;

using a square root of a total number of the plurality of LEDs to determine a first reference value being one of a floor value and a ceiling value of the square root;

arranging the plurality of LEDs as a first plurality of parallel connected LED cascades according to the first optimal working point, and a total number of the first plurality of parallel connected LED cascades of the plurality of LEDs equaling the first reference value, wherein a total number of serially connected LEDs in each of the first plurality of parallel connected LED cascades equals the first reference value;

using a power of $$\frac{1}{2k}$$

of the total number of the plurality of LEDs (N), to determine a k-th reference value being one of a floor value and a ceiling value of the power of $$\frac{1}{2k}$$

of N;

obtaining a k-th optimal working point;

arranging a k-th plurality of parallel connected LED cascades according to the k-th optimal working point; and connecting a (k−1)th plurality of LED cascades to the k-th plurality of parallel connected LED cascades, wherein a total number of parallel connected k-th LED cascades equals a positive integer being one of a floor value and a ceiling value of a power of $$\sum_{m=1}^{k} \frac{1}{2m}$$

of N, and a total number of serially connected LEDs in each of the k-th plurality of LED cascades equals the k-th reference value, wherein k is a positive integer and k>1.

* * * * *